US005901834A

United States Patent [19]

Inubushi et al.

[11] Patent Number: 5,901,834

[45] Date of Patent: May 11, 1999

[54] LIGHTED SWITCH ILLUMINATOR AND ITS FABRICATION METHOD

[75] Inventors: Toshiya Inubushi; Tsutomu Inoue, both of Tokyo, Japan

[73] Assignee: Mitsubishi Denki Kabushiki Kaisha, Tokyo, Japan

[21] Appl. No.: 08/947,912

[22] Filed: Oct. 9, 1997

[30] Foreign Application Priority Data

May 12, 1996 [JP] Japan ..... 8-325315
Jun. 24, 1997 [JP] Japan ..... 9-167072

[51] Int. Cl.[6] ..... H01H 13/70; H01H 9/00

[52] U.S. Cl. ..... 200/314; 200/317; 200/512; 200/515

[58] Field of Search ..... 200/5 R, 5 A, 200/512–517, 308, 310, 311–314, 317; 340/815.4, 815.42, 815.45, 815.47, 815.48, 815.49, 815.5, 815.53, 815.55, 815.73; 362/295; 379/364, 365, 368–370, 422, 433

[56] References Cited

U.S. PATENT DOCUMENTS

| | | | |
|---|---|---|---|
| 4,024,368 | 5/1977 | Shattuck | 200/314 |
| 4,060,703 | 11/1977 | Everett, Jr. | 200/5 A |
| 4,415,780 | 11/1983 | Daugherty et al. | 200/5 A |
| 4,532,395 | 7/1985 | Zukowski | 200/314 |
| 4,683,360 | 7/1987 | Maser | 200/314 |
| 4,916,262 | 4/1990 | Jungels-Butler et al. | 200/5 A |
| 5,570,114 | 10/1996 | Fowler | 345/173 |
| 5,669,486 | 9/1997 | Shima | 200/314 |
| 5,697,493 | 12/1997 | Sach et al. | 200/314 |

FOREIGN PATENT DOCUMENTS

| | | | |
|---|---|---|---|
| 62-15713 | 1/1987 | Japan | H01H 13/02 |
| 589743 | 4/1993 | Japan | H01H 13/02 |

*Primary Examiner*—Michael A. Friedhofer
*Attorney, Agent, or Firm*—Rothwell, Figg, Ernst & Kurz

[57] ABSTRACT

A lighted switch illuminator which solves a problem of a conventional device in that it was difficult to reduce its thickness and size because the electroluminescent (EL) layer functioning as an illuminator is adhered to a separate film click board. An EL layer is directly formed on a film click board by stacking its layers (consisting of a transparent electrode layer, a light emitting layer, a dielectric layer, a rear electrode layer and an insulation layer) in order excluding hollow convex portions of the film click board. Upper contacts and lower contacts are formed on the film click board and a printed board, respectively, such that they face each other. Depressing a key button pushes the corresponding hollow convex portion so that the upper contact and the corresponding lower contact are brought into conduction, in which case a good clicking feeling is obtained because the EL layer is not formed on the back of the hollow convex portions. Since the film click board is an integral part of the electroluminescent light, the thickness of the illuminator can be reduced.

20 Claims, 14 Drawing Sheets

LIGHTED SWITCH ILLUMINATOR AND ITS FABRICATION METHOD

BACKGROUND OF THE INVENTION

1. Field of the Invention

The present invention relates to a lighted switch illuminator used for operating electronic devices such as portable telephones, and its fabrication method.

2. Description of Related Art

A portable telephone employs lighted switches as a dial and functional switches. They are composed of key buttons illuminated by a backlight for facilitating manipulation on if a rather dark road at night or the like.

These electric devices including portable telephones have been made thinner and smaller with their increasing functions. In particular, thin-type portable telephones have been appearing, in which the thickness of their batteries occupy 70–80% of their total thickness. It is considered to be difficult to further reduce their thickness with maintaining the capacity of the batteries.

FIG. 23 is a perspective view of a conventional portable telephone. In this figure, the reference numeral 1 designates a front case, and 2 designates a rear case. These cases 1 and 2 constitute a main body case incorporating electronic devices such as a printed board on which ICs or LSIs are mounted. The reference numeral 3 designates a liquid crystal display (LCD) mounted on the front case 1, and 4 designates key buttons consisting of dial keys, function keys and the like disposed on the front case 1. The key buttons 4 are illuminated by backlight emitted from an illuminator not shown in this figure to facilitate their manipulation in a dark place. The reference numeral 5 designate a flip with its end rotatably fixed to the front case 1. Although its open state is shown in FIG. 23, it covers the key buttons when closed to protect them and prevent their misoperation. The reference numeral 6 designates a microphone mounted on the flip 5, 7 designates a speaker, and 8 designates a transmitting and receiving antenna.

FIGS. 24 and 25 are cross-sectional view of a portion of a lighted switch including one of the key buttons 4. The key button 4 is composed of a transparent material with numerals and marks printed on its face and with a protrusion 4*a* on its back. It is supported by an elastic material between the front case 1 and a printed board described below in such a manner that it can move in a vertical direction. The reference numeral 9 designates a film click board composed of a translucent plastics sheet, and 10 designates a hollow convex portion disposed such that it faces the back of the key button 4. The hollow convex portion 10 has a dome-like shape drawn out by pressing the film click board 9. The reference numeral 11 designates an electroluminescent (called EL for short below) light functioning as a light emitting source, which is composed of a base film 12, a transparent electrode layer 13, a light emitting layer 14, a dielectric layer 15, a rear electrode layer 16 and an insulation layer 17, which are successively stacked-on the back of the film click board 9. The reference numeral 18 designates a double-sided adhesive tape for bonding the back of the film click board 9 and the face of the EL light 11; 19 designates a switch electrode sheet, on which a switch circuit corresponding to a plurality of key buttons are printed; 20 designates upper contacts consisting of carbon ink printed on the back of the switch electrode sheet 19; 21 designates a printed board including electronic components constituting a transmitter and receiver, radio circuits or the like mounted or printed thereon; 22 designates a spacer interposed between the printed board 21 and the switch electrode sheet 19; and 23 designates a lower contact provided on the printed board 21 such that it faces the upper contact 20.

Next, the operation of the conventional lighted switch illuminator will be described.

With depressing the key button 4 in the state as shown in FIG. 24, the protrusion 4*a* of the key button 4 presses the hollow convex portion 10 of the film click board 9 and changes its form. When the hollow convex portion 10 changes its form beyond a certain level, it inverts its shape to protrude to the opposite side, thereby depressing the EL light 11 and the switch electrode sheet 19, and making the upper contact 20 and lower contact 23 contact to establish conduction. This state is shown in FIG. 25. When the upper contact 20 and lower contact 23 are connected, a switch circuit printed on the switch electrode sheet 19 generates a control signal so that a CPU governing the functions of the portable telephone, for example, detects that one of the key buttons 4 has been depressed, and carries out corresponding display on the liquid crystal display 3.

The switch has a lighted switch structure, in which the light emitted from the light source EL light 11 illuminates the back of the key button 4.

More specifically, the EL light 11, composed of the base film 12, transparent electrode layer 13, light emitting layer 14, dielectric layer 15, rear electrode layer 16 and insulation layer 17 which are stacked in this order, emits light when electric field excitation and collision of electrons to the light emitting layer 14 are induced by applying an ac voltage between the transparent electrode layer 13 and the rear electrode layer 16.

The operation feeling of the key button will be explained with reference to FIGS. 26–28.

FIGS. 26–28 are characteristic diagrams whose vertical axis represents the load and horizontal axis represents the stroke when manipulating the key button 4. In these diagrams, P1 and P1' each designate a load immediately before the film click board 9 is inverted while it is depressed by the key button 4 and changing its form, S1 designates a stroke of the key button 4 at that time, P2 and P2' each designate a load at the instant when the film click board 9 is inverted and the upper contact 20 contacts the lower contact 23, and S2 designates the stroke at that instant.

One of the factors determining the operation feeling of the key button is a clicking feeling, which is considered to be improved with an increase of a click ratio (P1−P2)/P1, and a decrease of the difference S2−S1.

The conventional lighted switch as shown in FIGS. 24 and 25 cannot cause the upper contact 20 to contact the lower contact 23 unless the EL light 11 and the switch electrode sheet 19 are warped as well as the film click board 9. In other words, it has the characteristic as shown in FIG. 28 obtained by superimposing the characteristic curve of the film click board 9 as shown in FIG. 26 over the characteristic curve of the EL light 11 and the switch electrode sheet 19 as shown in FIG. 27.

Accordingly, the original click ratio (P1−P2)/P1 of the film click board 9 is reduced to (P1'−P2')/P1' owing to the EL light 11 and switch electrode sheet 19, and hence a good clicking feeling cannot be achieved in the conventional lighted switch as shown in FIGS. 24 and 25.

As described above, the conventional lighted switch is assembled by bonding the separate film click board 9 and the EL light 11 of the illuminator functioning as the light source by using the double-sided adhesive tape 18. As a result, its thickness h remains large as indicated in FIG. 24, which poses a problem in that the external dimensions of the lighted switch and the electronic equipment using it cannot be made thinner and smaller.

SUMMARY OF THE INVENTION

The present invention is implemented to solve the foregoing problem. It is therefore an object of the present invention to provide a lighted switch which can make thinner and smaller the external dimensions of the lighted switch and electronic equipment using it by shrinking the size of the illuminator.

Another object of the present invention is to provide a lighted switch with an improved clicking feeling.

Still another object of the present invention is to provide a fabrication method of a lighted switch illuminator that can reduce its size and improve the click feeling.

According to a first aspect of the present invention, there is provided a lighted switch illuminator provided at a back of one of more key buttons for illuminating the key buttons, the lighted switch illuminator comprising: a base film having its first surface operatively depressed by the key buttons; one or more first contacts formed on a second surface of the base film at regions corresponding to the key buttons; one or more second contacts formed on a printed board such that each of the second contacts faces each one of the first contacts; and one EL (electroluminescent) layer formed on the second surface of the base film excluding the regions at which the first contacts are formed.

Here, the base film may be a film click board with its first surface facing the key buttons.

The base film may a switch electrode sheet on which printed wiring of a switch circuit is formed.

The film click board may have on its first surface one or more hollow convex portions each protruding toward the back of each one of the key buttons.

The film click board may a flat film.

The EL layer may consist of ring-like layers formed at regions surrounding on the back of the film click board the hollow convex portions.

The EL layer may have air grooves opening interiors of the hollow convex portions to outside.

The EL layer may have air grooves for transmitting air between a predetermined number of hollow convex portions.

The EL layer may extend into interiors of the hollow convex portions.

The lighted switch illuminator may further comprise a film click board having one or more hollow convex portions each protruding toward the back of each one of the key buttons, and the EL layer may consist of ring-like layers each formed on the second surface of the switch electrode sheet at a region corresponding to a periphery and part of an interior of each one of the hollow convex portions.

According to a second aspect of the present invention, there is provided a lighted switch illuminator provided at a back of one or more key buttons for illuminating the key buttons, the lighted switch illuminator comprising: a film click board having on its first surface one or more hollow convex portions each protruding toward the back of each one of the key buttons; one or more first contacts operatively depressed by the key buttons, each of the first contacts corresponding to each one of the key buttons; one or more second contact formed on a printed board such that each of the second contacts faces each one of the first contacts; and an EL (electroluminescent) layer formed at least at a back of the hollow convex portions on the film click board.

Here, the first contacts may be formed on the EL layer.

The lighted switch illuminator may further comprise a switch electrode sheet with its first surface facing the film click board and the EL layer, and the first contacts may be formed on a second surface of the switch electrode sheet at regions corresponding to the key buttons.

The EL layer may be formed throughout the second surface of the film click board.

The EL layer may consist of a plurality of unit layers each formed on a back of each one of the hollow convex portions.

The EL layer may comprise a transparent electrode layer, a light emitting layer, a dielectric layer, a rear electrode layer and an insulation layer stacked in order.

According to a third aspect of the present invention, there is provided a fabrication method of a lighted switch illuminator comprising the steps of: forming one or more hollow convex portions protruding from a first surface of a film click board; forming an EL (electroluminescent) layer on a second surface of the film click board excluding regions corresponding to the hollow convex portions; and forming one or more switch contacts at a back of the hollow convex portions.

According to a fourth aspect of the present invention, there is provided a fabrication method of a lighted switch illuminator comprising the steps of: forming one of more hollow convex portions protruding from a first surface of a film click board; forming part of an EL (electroluminescent) layer by successively stacking a transparent electrode layer, a light emitting layer and a dielectric layer on a second surface of the film click board excluding regions corresponding to the hollow convex portions; stacking on the dielectric layer a rear electrode layer composed of carbon ink, and simultaneously forming at a back of the hollow convex portions switch contacts composed of the carbon ink; and stacking on the rear electrode layer an insulation layer, thereby completing the EL layer.

According to a fifth aspect of the present invention, there is provided a fabrication method of a lighted switch illuminator comprising the steps of: forming one or more hollow convex portions protruding from a first surface of a film click board; forming an EL (electroluminescent) layer on a second surface of the film click board at least at regions corresponding to the hollow convex portions; and forming one or more switch contacts on the EL layer at regions corresponding to the hollow convex portions.

BRIEF DESCRIPTION OF THE DRAWINGS

FIGS. 15A–5C are plan, side and bottom views of the film click board associated with an embodiment 11 of the lighted switch illuminator in accordance with the present invention, respectively;

FIGS. 18A–8C are plan, side and bottom views of the film click board of an embodiment 13 of the lighted switch illuminator in accordance with the present invention, respectively;

DETAILED DESCRIPTION OF THE PREFERRED EMBODIMENTS

The invention will now be described with reference to the accompanying drawings.

EMBODIMENT 1

Figure 1:
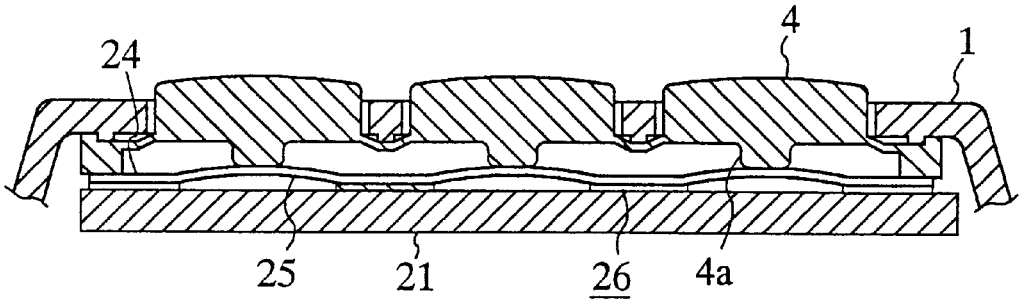
FIG. 1 is a cross-sectional view showing an embodiment 1 of a lighted switch illuminator in accordance with the present invention in connection with a light switch.
Figures 2A, 2B, 2C:
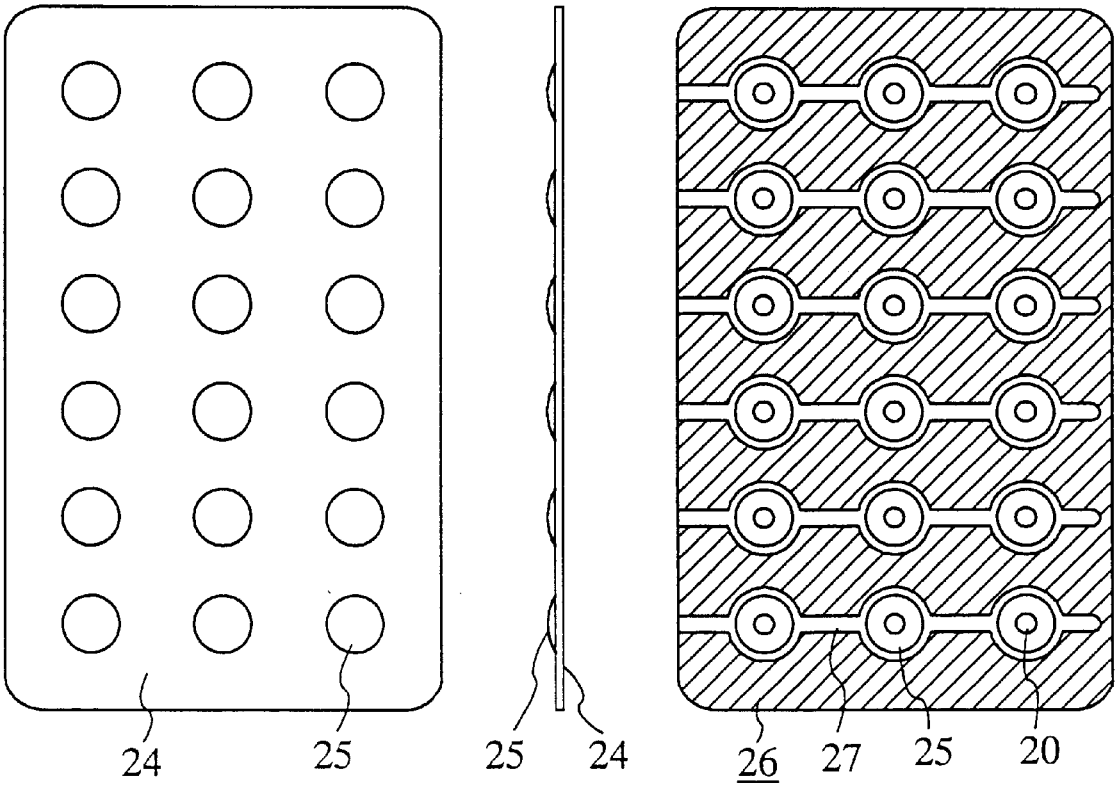
FIGS. 2A–2C are plan, side and bottom views of the film click board of the embodiment 1 of the present invention, respectively.
Figure 3:
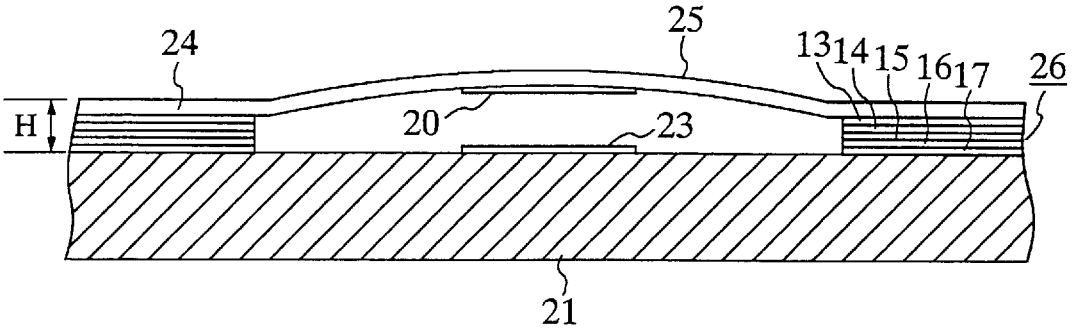
FIG. 3 s an enlarged cross-sectional view of the embodiment 1 of the present invention.
Figure 24:
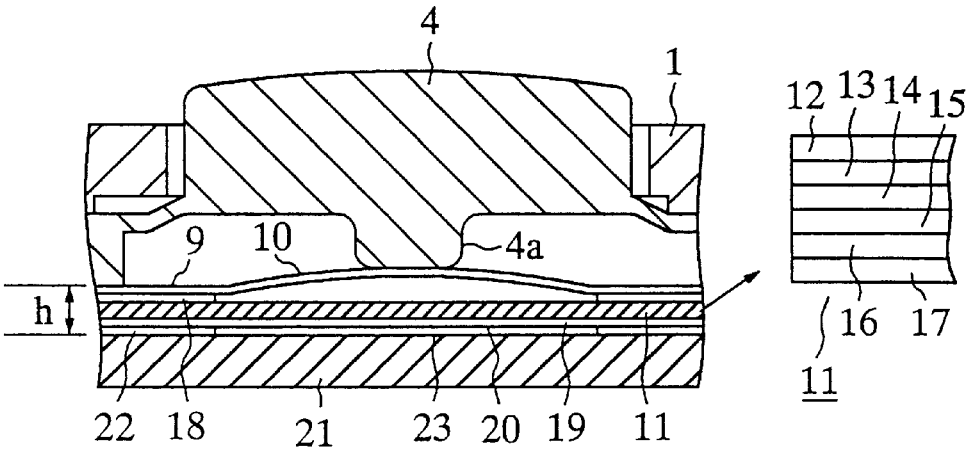
FIG.24(PRIOR ART)
FIG. 24 is a cross-sectional view of a conventional lighted switch illuminator when its switch is open.
Figure 25:
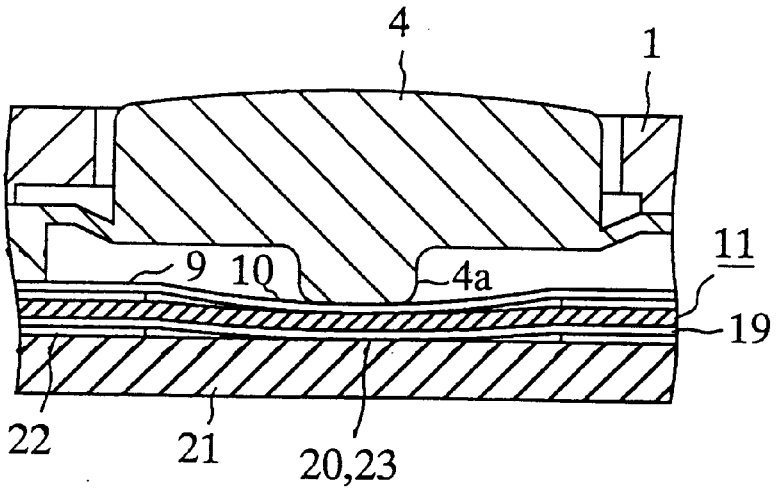
FIG.25(PRIOR ART)
FIG. 25 is a cross-sectional view of the conventional lighted switch illuminator when its switch is closed.
Figure 26:
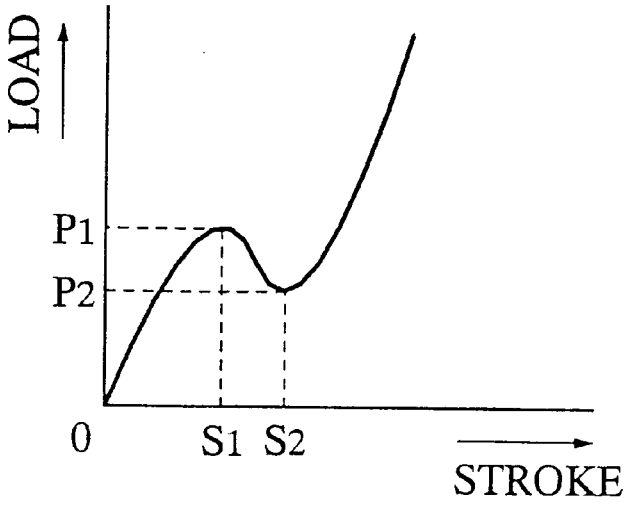
FIG.26 (PRIOR ART)
FIG. 26 is a diagram illustrating characteristics of the film click board 9 of the conventional lighted switch illuminator when it is depressed by a key button.
Figure 27:
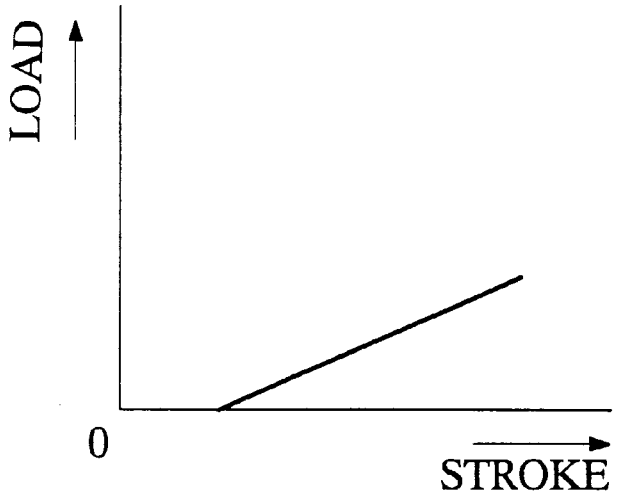
FIG.27 (PRIOR ART)
FIG. 27 is a diagram illustrating characteristics of the EL light 11 and switch electrode sheet 19 of the conventional lighted switch illuminator when they are depressed by the key button.
Figure 28:
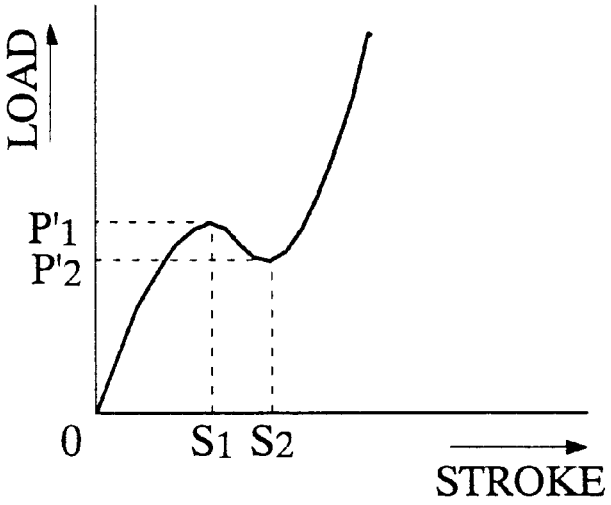
FIG.28 (PRIOR ART)
FIG. 28 is a diagram illustrating depression characteristics of the conventional key button.

FIG. 1 is a cross-sectional view of an embodiment 1 of a lighted switch illuminator in accordance with the present invention in connection with a lighted switch, FIGS. 2A–2C are plan, side and bottom views of a film click board of the embodiment 1, and FIG. 3 is an enlarged cross-sectional view of the embodiment 1. In these figures, the reference numeral 24 designates a film click-board, in which a plurality of dome-like hollow convex portions 25 are arranged in rows and columns. The hollow convex portions 25 protrude toward the protrusions 4*a* formed on the back of the key buttons 4. The film click board 24 has functions not only those of the conventional film click board 9 as shown in FIGS. 24 and 25, but also those of the base film 12 constituting the conventional EL light 11. Specifically, the film click board 24 functions as a base film, except for the portions corresponding to the hollow convex portion 25, of a stack consisting of the transparent electrode layer 13, light emitting layer 14, dielectric layer 15, rear electrode layer 16 and insulation layer 17 arranged in this order, and constitutes the EL light 11 together with these layers. The stack consisting of the transparent electrode layer 13, light emitting layer 14, dielectric layer 15, rear electrode layer 16 and insulation layer 17 will be called an EL layer 26 below for the purpose of convenience. The reference numeral 20 designates upper contacts provided on concave portions at the back of the hollow convex portions 25, 23 designates lower contacts provided on the printed board 21 in such a fashion that they face the upper contacts 20, and 27 designates air grooves opening the internal space of the hollow convex portion 25 to the external space. In FIG. 2B, the EL layer 26 is not shown for the purpose of simplicity.

Next, the operation will be described.

With depressing one of the key buttons 4, the protrusion 4*a* of the key button 4 presses the corresponding hollow convex portion 25 of the film click board 24 and changes its form, and the air in the hollow convex portion 25 is partially discharged to the outside through the air groove 27. Thus, the air is not compressed, and hence does not hinder the change of the form of the hollow convex portion 25.

When the key button 4 is further depressed, the hollow convex portion 25 inverts its shape to protrude to the opposite side, thereby making the upper contact 20 provided on the concave portion at its back contact the lower contact 23 provided on the printed board 21 to establish conduction. A switch circuit of the key button 4, which is printed on the printed board 21, generates a control signal due to the depression of the key button 4 when the upper contact 20 and lower contact 23 conduct.

The illumination of the key button 4 is carried out by applying an ac voltage across the transparent electrode layer 13 and rear electrode layer 16 of the EL light 11 consisting of the film click board 24 and the EL layers 26: The light emitted illuminates the back of the key button 4. In this case, although it would be expected that the illuminance be reduced as compared with that of the conventional device as shown in FIGS. 24 and 25 because of the lack of the EL layer 26 at the back of the hollow convex portion 25, it was confirmed that sufficient illuminance was obtained as a result of tests on a trial model. In addition, the illuminance can be improved by increasing the frequency of the ac voltage applied across the transparent electrode layer 13 and the rear electrode layer 16.

According to the embodiment 1 of the lighted switch illuminator, its thickness H can be reduced by an amount of about 0.2–0.3 mm as compared with that of the conventional device because the spacer 22 and the film click board 9 separately attached on the EL light 11 can be removed. Furthermore, since the EL layer is not formed at the back of the hollow concave portions 25, the ratio (P1–P2)/P1 can be increased, resulting in a good click feeling. As a material for making up the film click board 24, translucent plastics such as polyester sheet can be used as with the conventional film click board 9.

EMBODIMENT 2

Figures 4A, 4B, 4C:
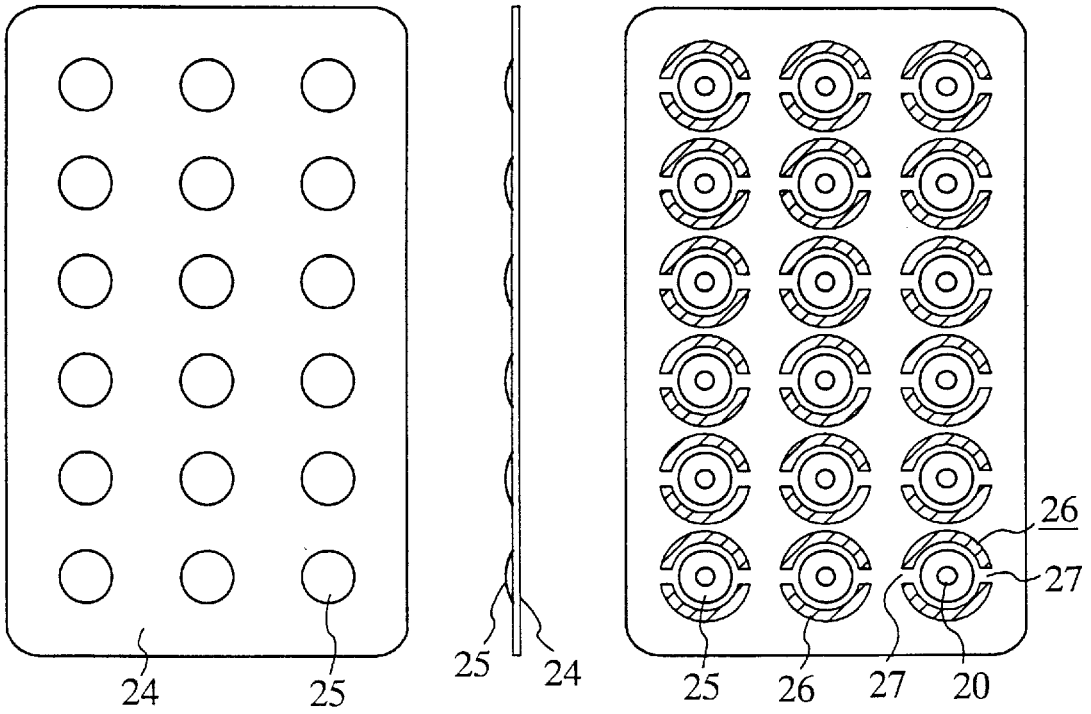
FIGS. 4A–4C are plan, side and bottom views of the film click board of an embodiment 2 of the lighted switch illuminator in accordance with the present invention, respectively.

FIGS. 4A–4C are plan, side and bottom views showing the film click board of an embodiment 2 of the lighted switch illuminator in accordance with the present invention. In FIG. 4B, the EL layer 26 at the back is also omitted as in the drawings from now on.

The embodiment 2 of lighted switch illuminator has ring-shaped EL layers 26 each formed by sequentially stacking its layers around the dome-like hollow convex portion 25 as shown in FIG. 4C. Air grooves 27 are formed by cutting out parts of the respective ring-like EL layers 26.

The embodiment 2 of the lighted switch illuminator in accordance with the present invention can reduce its thickness and size, and improve the click feeling as the embodiment 1. In addition, the luminance efficiency of the key button 4 per consumed current of the EL light 11 is also increased, which can prolong the life of the battery. This has an advantage when applying the lighted switch to portable electronic equipment. Incidentally, the ac power supply driving the EL light 11 in the portable equipment is obtained by converting the dc voltage of the battery to the ac voltage by an inverter.

EMBODIMENT 3

Figure 5A:
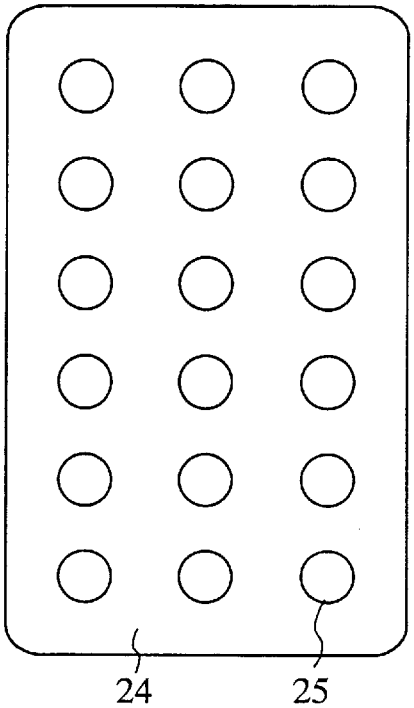
FIGS. 5A–5C are plan, side and bottom views of the film click board of an embodiment 3 of the lighted switch illuminator in accordance with the present invention, respectively.
Figure 5B:
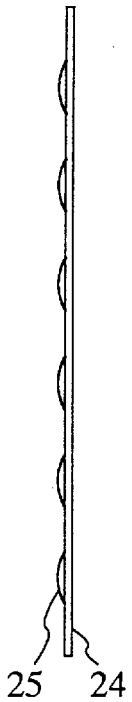
Figure 5C:
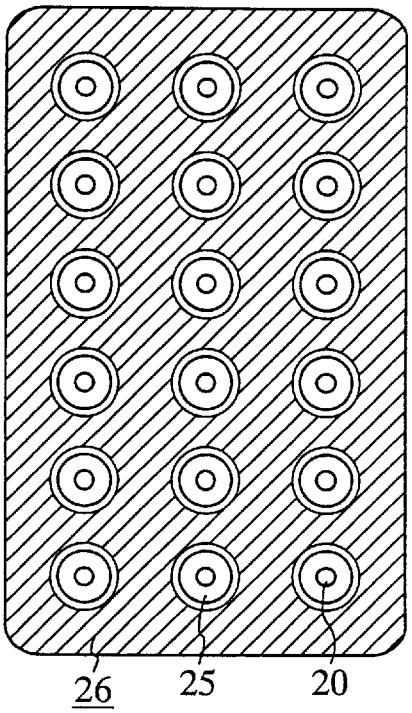

FIGS. 5A–5C are plan, side and bottom views of the film click board of an embodiment 3 of the lighted switch illuminator in accordance with the present invention.

This embodiment 3 has an EL layer 26 formed by stacking its layers on almost all the back of the film click board 24 excluding the portions corresponding to the hollow convex portions 25 without forming any air grooves. In this case, although the thickness of the EL layer 26 must be provided throughout, this does not hinder the reduction in thickness and size of the device.

According to the embodiment 3, removing the air grooves can prevent dust from intruding from the outside. This can improve the reliability of the contact between the upper and lower contacts 20 and 23.

EMBODIMENT 4

Figure 6A:
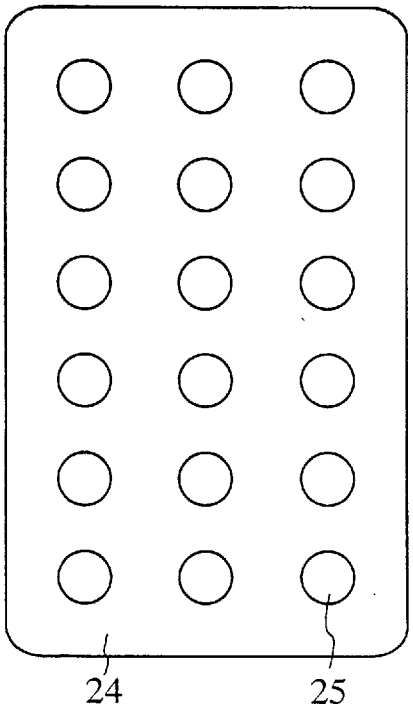
FIGS. 6A–6C are plan, side and bottom views of the film click board of an embodiment 4 of the lighted switch illuminator in accordance with the present invention, respectively.
Figure 6B:
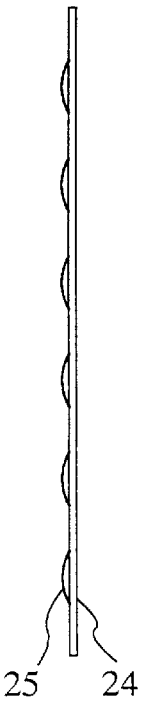
Figure 6C:
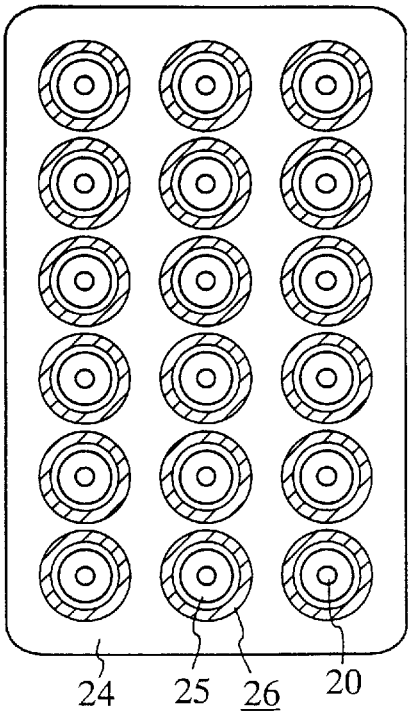

FIGS. 6A–6C are plan, side and bottom views of the film click board of an embodiment 4 of the lighted switch illuminator in accordance with the present invention.

This embodiment 4 has ring-like EL layers 26 formed by sequentially stacking their layers around the dome-like hollow convex portions 25 as in the embodiment 2, without forming the air grooves.

Thus, the embodiment 4 can reduce its thickness and size, increase the luminance efficiency of the key button 4 per consumed current of the EL light 11, and prevent dust from intruding from the outside.

EMBODIMENT 5

Figure 7A:
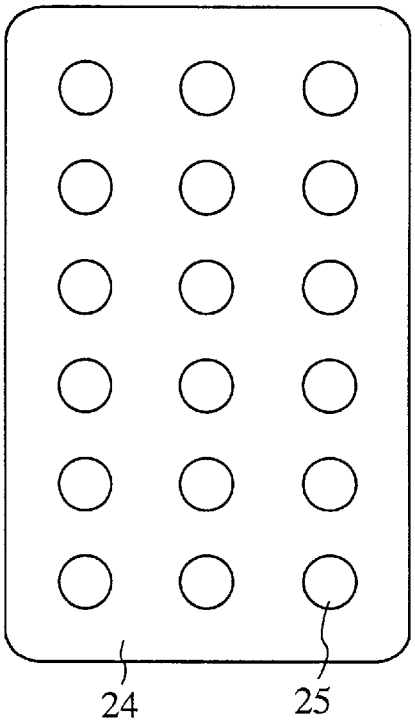
FIGS. 7A–7C are plan, side and bottom views of the film click board of an embodiment 5 of the lighted switch illuminator in accordance with the present invention, respectively.
Figure 7B:
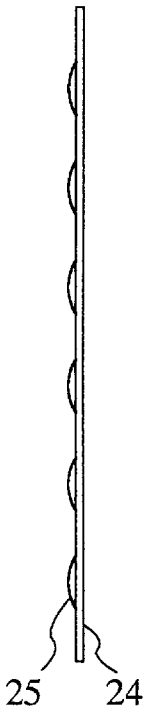
Figure 7C:
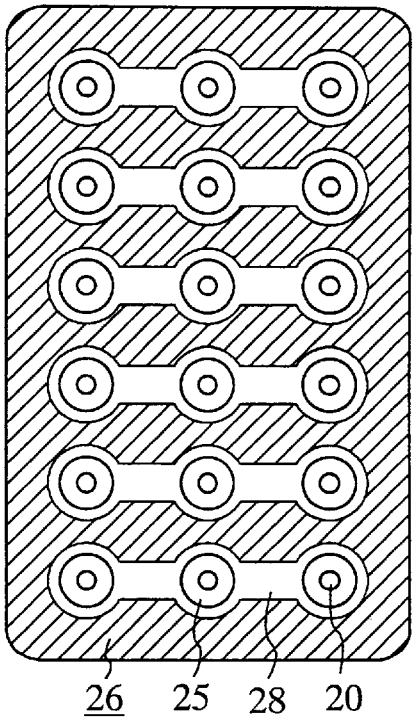

FIGS. 7A–7C are plan, side and bottom views of the film click board of an embodiment 5 of the lighted switch illuminator in accordance with the present invention.

This embodiment 5 has an EL layer 26 formed on almost all the back of the film click board 24 excluding the hollow convex portions 25, and air grooves 28 each communicating among three hollow convex portions 25 in a row by cutting out parts of the EL layer 26. The provision of the air grooves 28 can increase the space for passing the air through when the hollow convex portion 25 is depressed, thus reducing the effect of the air compression force to a negligible degree.

As a result, the embodiment 5 can reduce its thickness and size, provide a good click feeling, and prevent dust from intruding from the outside.

EMBODIMENT 6

Figure 8A:
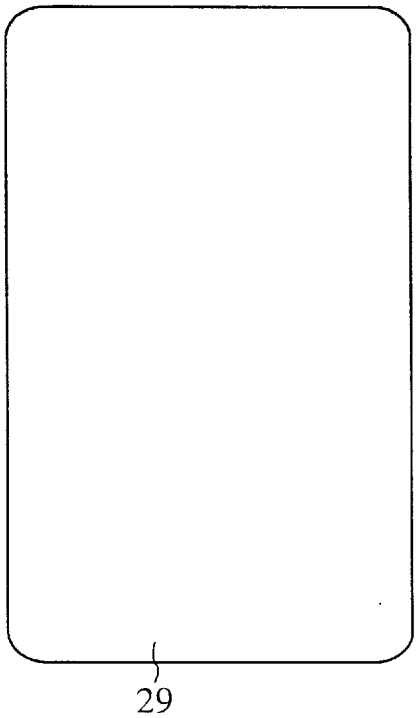
FIGS. 8A–8C are plan, side and bottom views of the film click board of an embodiment 6 of the lighted switch illuminator in accordance with the present invention, respectively.
Figure 8B:
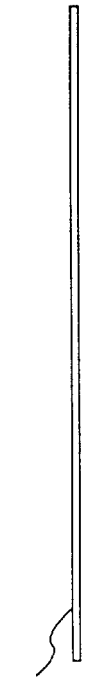
Figure 8C:
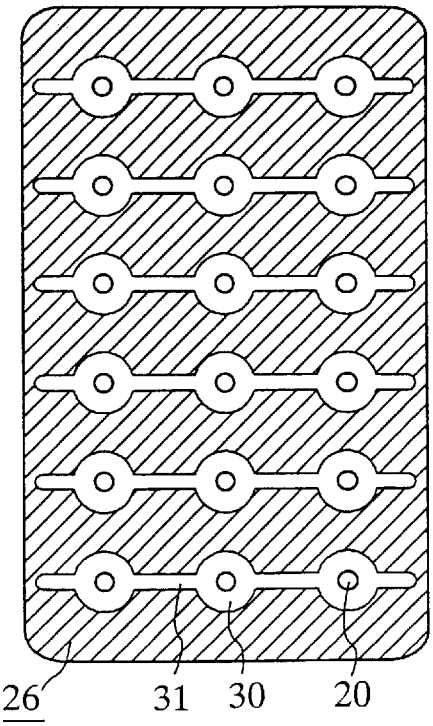

FIGS. 8A–8C are plan, side and bottom views of the film click board of an embodiment 6 of the lighted switch illuminator in accordance with the present invention.

Although the foregoing embodiments 1–5 have the film click board 24 provided with the dome-like hollow convex portions 25 at positions corresponding to the key buttons 4 to obtain the click feeling, this is not essential if the click feeling is not required. For example, a flat base film 29 without any hollow convex portions as shown in FIGS. 8A–8C can be employed. This embodiment 6 has the EL layer 26 formed on the back of the base film 29 excluding regions 30 facing the key buttons 4, and air grooves 31 each communicating between three regions 30 in a row by cutting out parts of the EL layer 26.

Thus, the embodiment 6 can reduce its thickness and size, and prevent dust from intruding from the outside.

EMBODIMENT 7

Figure 9A:
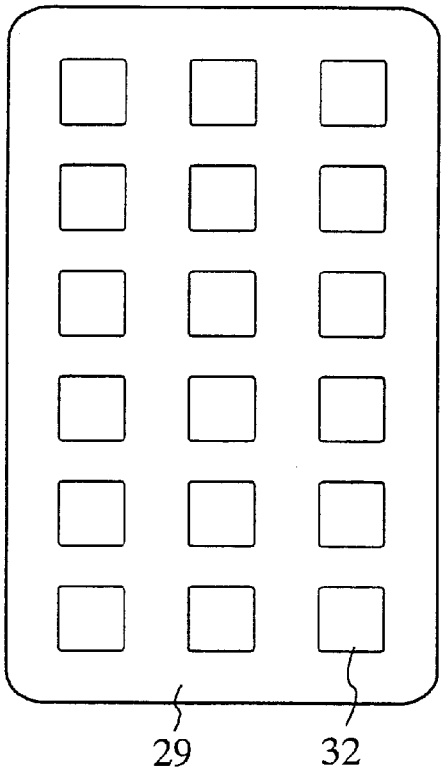
FIGS. 9A–9C are plan, side and bottom views of the film click board of an embodiment 7 of the lighted switch illuminator in accordance with the present invention, respectively.
Figure 9B:
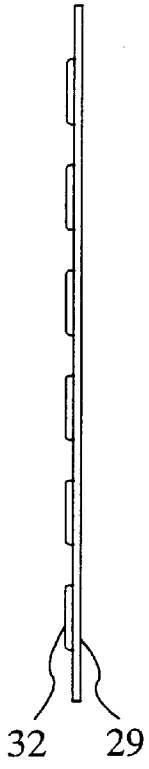
Figure 9C:
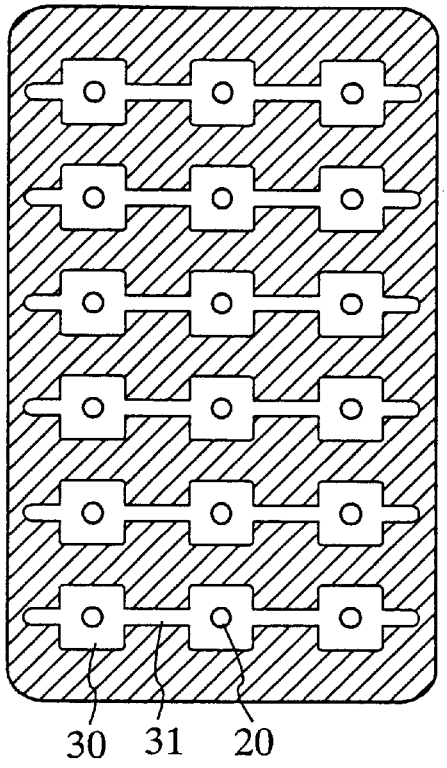

FIGS. 9A–9C are plan, side and bottom views of the film click board of an embodiment 7 of the lighted switch illuminator in accordance with the present invention.

Although the foregoing embodiment 6 has the flat base film 29, it is not essential. For example, when depressing the base film 29 directly without using the key buttons, the base film 29 can be provided with square hollow protrusions 32 as shown in FIGS. 9A–9C.

EMBODIMENT 8

Figure 10:
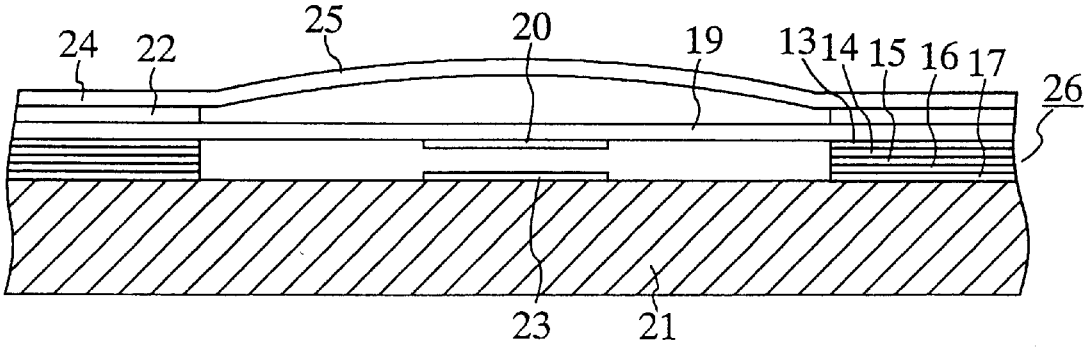
FIG. 10 is a cross-sectional view showing an embodiment 8 of the lighted switch illuminator in accordance with the present invention.

FIG. 10 is a cross-sectional view showing an embodiment 8 of the lighted switch illuminator in accordance with the present invention.

The embodiment 8 is characterized in that the spacer 22 and switch electrode sheet 19 are sandwiched between the film click board 24 and the EL layer 26, and that the upper contact 20 are formed on the back of the switch electrode sheet 19. The EL layer 26 is formed by sequentially stacking, on the switch electrode sheet 19 used as the base film, the transparent electrode layer 13, the light emitting layer 14, the dielectric layer 15, the rear electrode layer 16 and the insulation layer 17.

According to the embodiment 8, although its thickness increases slightly, the switch circuit can be printed on the switch electrode sheet 19. This makes it possible to reduce the printed pattern of the printed board 21 and improve the click feeling as compared with the conventional device.

EMBODIMENT 9

Figures 11A, 11B, 11C:
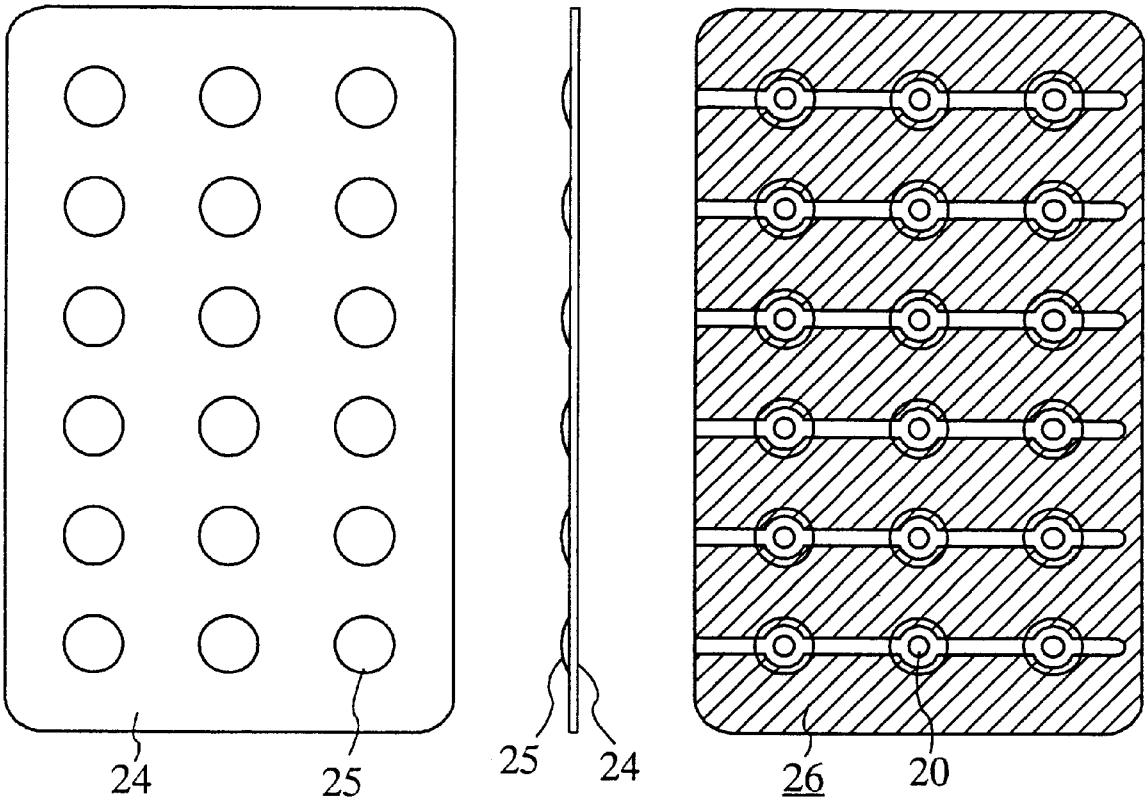
FIGS. 11A–11C are plan, side and bottom views of the film click board of an embodiment 9 of the lighted switch illuminator in accordance with the present invention, respectively.
Figure 12:
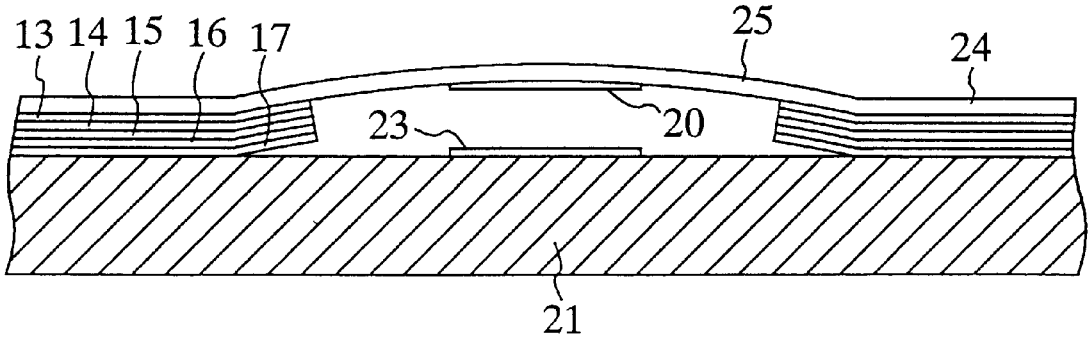
FIG. 12 is a cross-sectional view of the embodiment 9 of the lighted switch illuminator in accordance with the present invention.

FIGS. 11A–11C are plan, side and bottom views of the film click board of an embodiment 9 of the lighted switch illuminator in accordance with the present invention, and FIG. 12 is an enlarged cross-sectional view showing a part of the lighted switch.

This embodiment 9 is characterized in that the EL layer 26 is stacked in such a manner that it extends even to inner part of the hollow convex portions 25, with remaining only their top regions uncovered by the layer 26 as shown in FIG. 12.

The embodiment 9 can also reduce its thickness and size, and achieve a good click feeling.

EMBODIMENT 10

Figures 13A, 13B, 13C:
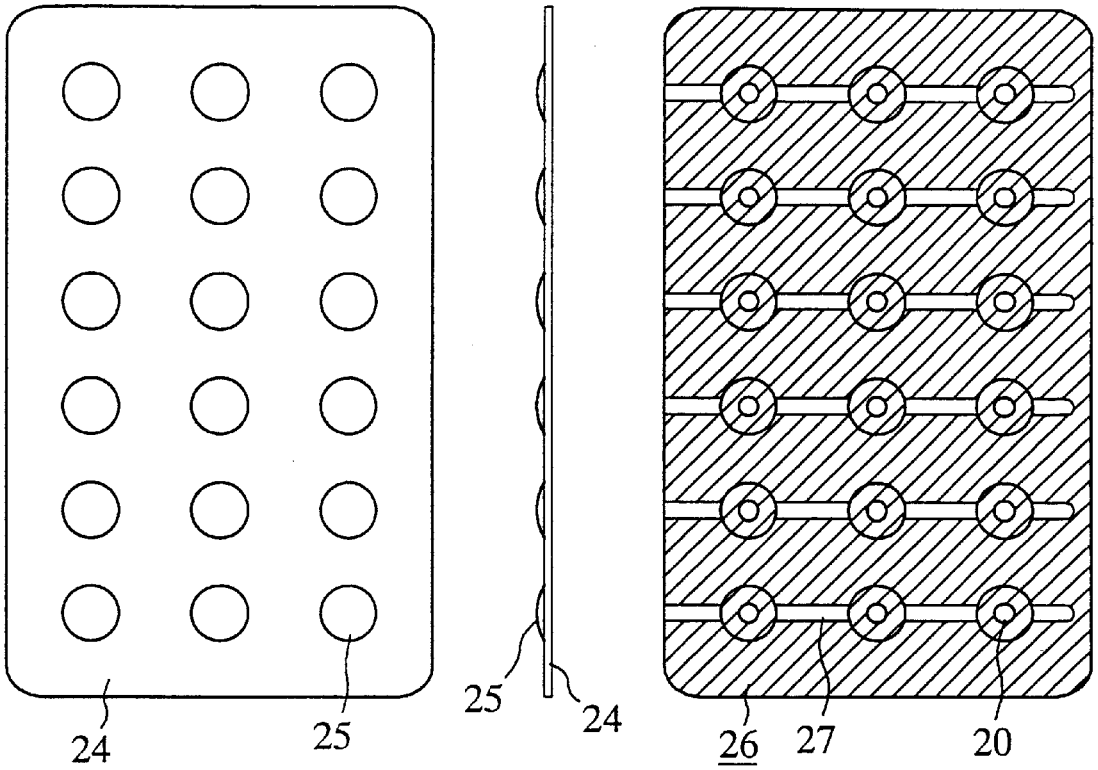
FIGS. 13A–13C are plan, side and bottom views of the film click board of an embodiment 10 of the lighted switch illuminator in accordance with the present invention, respectively.
Figure 14:
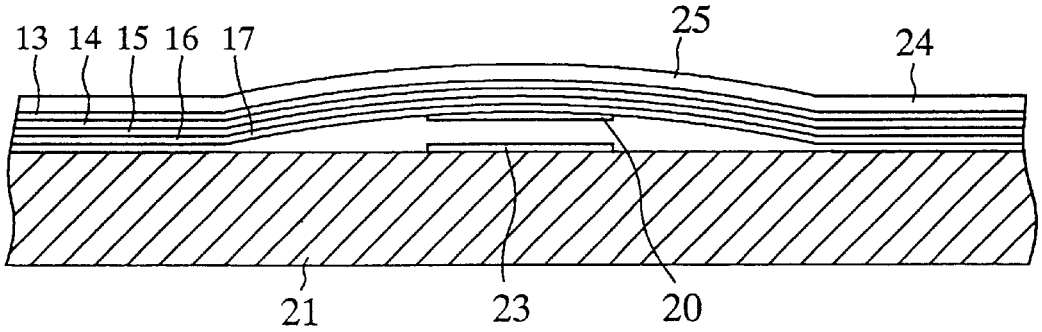
FIG. 14 is a cross-sectional view of the embodiment 10 of the lighted switch illuminator in accordance with the present invention.

FIGS. 13A–13C are plan, side and bottom views of the film click board of an embodiment 9 of the lighted switch illuminator in accordance with the present invention, and FIG. 14 is an enlarged cross-sectional view showing a part of the lighted switch.

This embodiment 10 is characterized in that the EL layer 26 is stacked throughout the back of the film click board 24 including the hollow convex portions 25, as shown in FIG. 14.

The embodiment 10 can also reduce its thickness and size, and increase luminance of lighting the key buttons.

EMBODIMENT 11

Figures 15A, 15B, 15C:
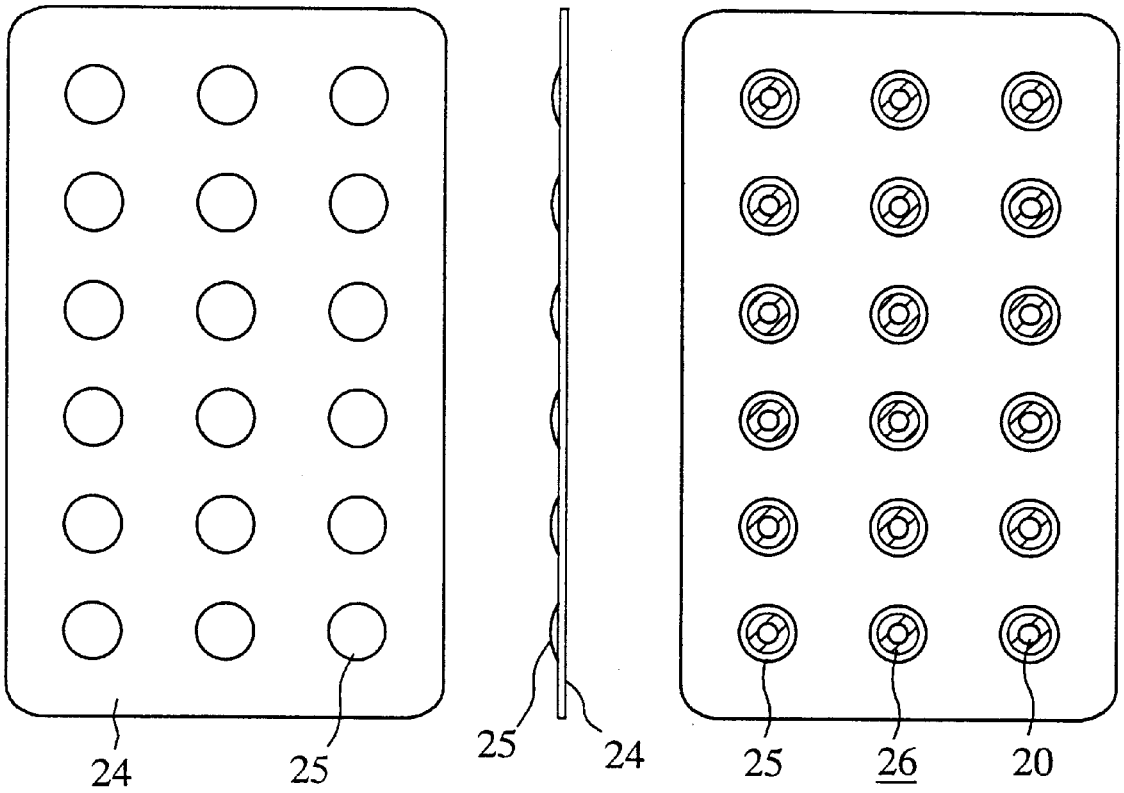
Figure 16:
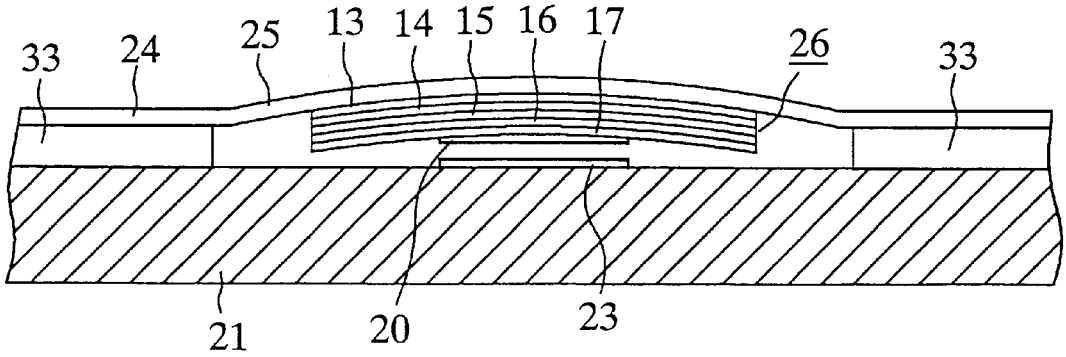
FIG. 16 is a cross-sectional view of the embodiment 11 of the lighted switch illuminator in accordance with the present invention.

FIGS. 15A–15C are plan, side and bottom views of the film click board of an embodiment 11 of the lighted switch illuminator in accordance with the present invention, and FIG. 16 is an enlarged cross-sectional view showing a part of the lighted switch.

Although the foregoing embodiments has the EL layer 26 formed on almost all the portions of the film click board 24 excluding the hollow convex portions 25, the present embodiment 11 has its EL layers 26 stacked only on concave portions at the back of the hollow convex portions 25.

In these figures, the reference numeral 33 designates a spacer interposed between the film click board 24 and the printed board 21, 26 designates the EL layers formed by sequentially stacking their layers on the concave portions at the back of the hollow convex portions 25 of the film click board 24, and 20 designates upper contacts further stacked on the insulation layer 17 of the EL layer 26.

Since the present embodiment 11 has its EL layers 26 formed on the concave portions at the back of the hollow convex portions 25 of the film click board 24, it can reduce its thickness and size. In addition, provision of the EL layers 26 directly under the back of the key buttons 4 has an advantage of improving the illuminance efficiency of the key buttons 4 per consumed current of the EL light 11.

EMBODIMENT 12

Figure 17:
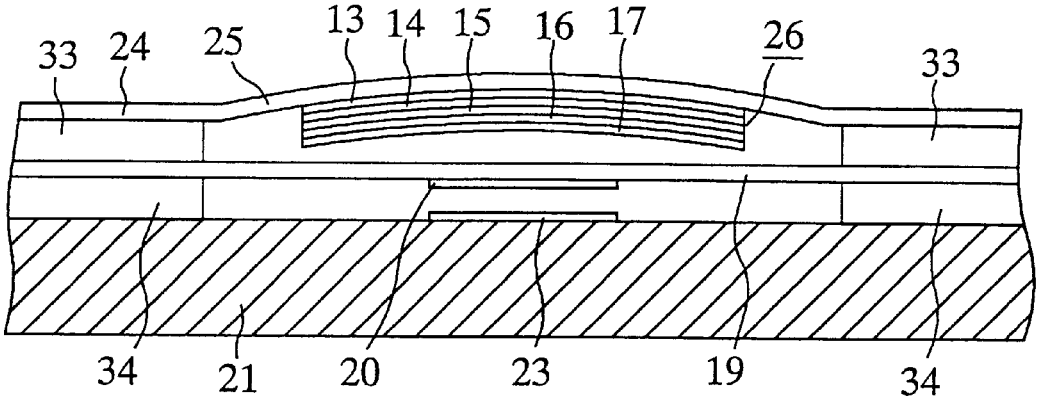
FIG. 17 is a cross-sectional view of an embodiment 12 of the lighted switch illuminator in accordance with the present invention.

FIG. 17 is an enlarged cross-sectional view showing a part of an embodiment 12 of the lighted switch illuminator in accordance with the present invention.

In FIG. 17, the reference numeral 34 designates a spacer, and 19 designates a switch electrode sheet which has switch circuits corresponding to the key buttons 4 printed on its surface, and upper contacts 20 on its back.

Although the embodiment 12 has the EL layers 26 stacked on concave portions at the back of the hollow convex portions 25 of the film click board 24 as in the embodiment 11, the upper contacts 20 are formed at the back of the switch electrode sheet 19, facing the lower contacts 23.

According to the present embodiment 12, although the thickness slightly increases as compared with the embodiment 11, it can still reduce its thickness and size. In addition, provision of the EL layers 26 directly under the back of the key buttons 4 has an advantage of improving the illuminance efficiency of the key buttons 4 per consumed current of the EL light 11.

EMBODIMENT 13

Figures 18A, 18B, 18C:
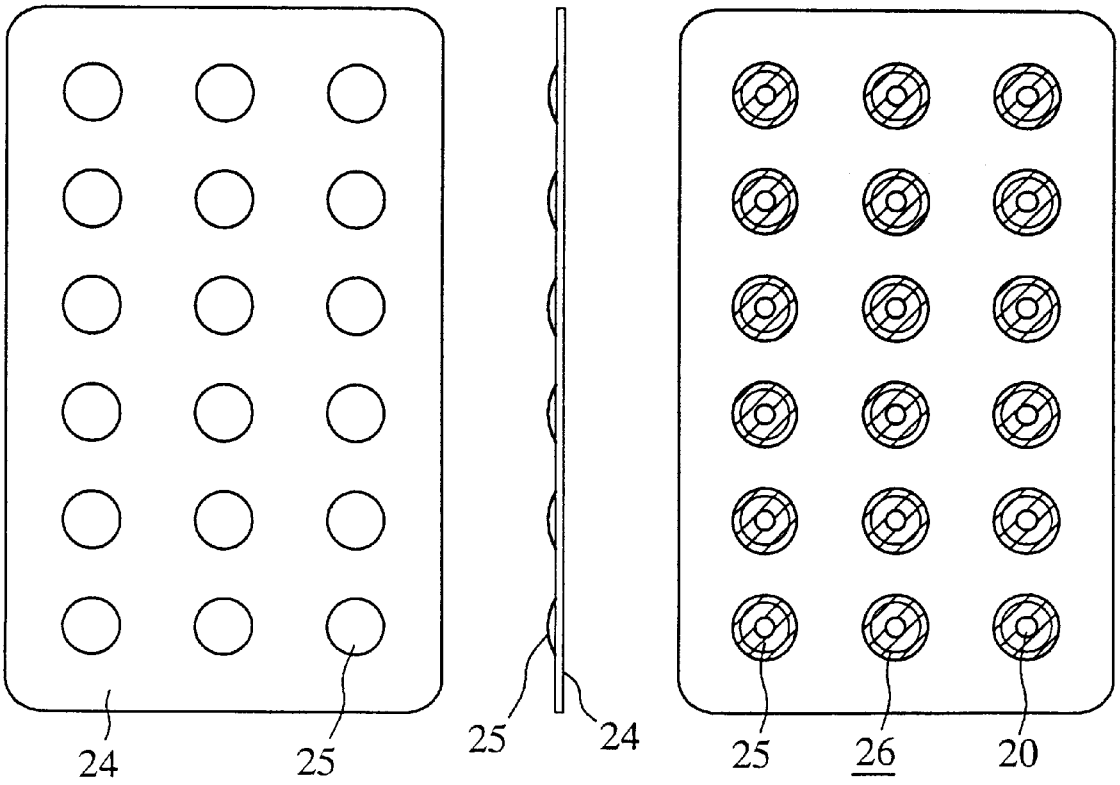
Figure 19:
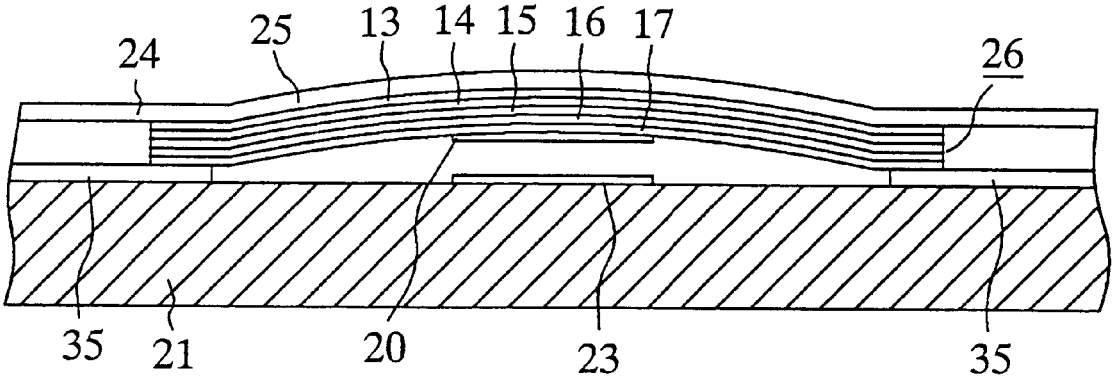
FIG. 19 is a cross-sectional view of the embodiment 13 of the lighted switch illuminator in accordance with the present invention.

FIGS. 18A–18C are plan, side and bottom views of the film click board of an embodiment 13 of the lighted switch illuminator in accordance with the present invention, and FIG. 19 is an enlarged cross-sectional view showing a part of the lighted switch, in which the reference numeral 35 designates a spacer.

Although the embodiment 11 has its EL layers 26 stacked only on concave portions at the back of the hollow convex portions 25, this embodiment 13 has the EL layers 26 stacked on the concave portions and their peripheries.

According to the present embodiment 13, although the thickness slightly increases as compared with the embodiment 11, it can still reduce its thickness and size. In addition, provision of the EL layers 26 directly under the back of the key buttons 4 has an advantage of improving the illuminance efficiency of the key buttons 4 per consumed current of the EL light 11.

EMBODIMENT 14

Figure 20:
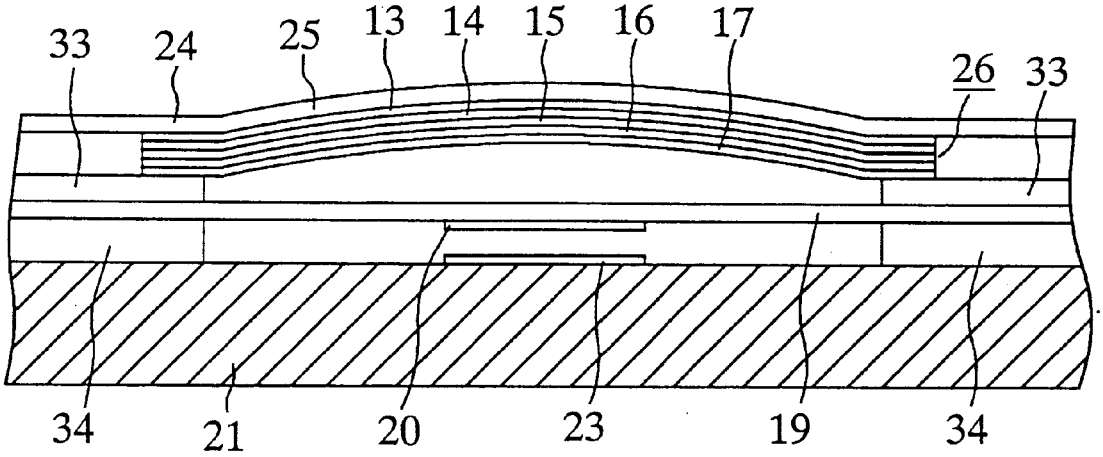
FIG. 20 is a cross-sectional view of an embodiment 14 of the lighted switch illuminator in accordance with the present invention.

FIG. 20 is an enlarged cross-sectional view showing a part of an embodiment 14 of the lighted switch illuminator in accordance with the present invention.

Although the embodiment 12 has its EL layers 26 stacked only on concave portions at the back of the hollow convex portions 25, this embodiment 14 has the EL layers 26 stacked on the concave portions and their peripheries.

The present embodiment 14 can reduce its thickness and size as the embodiment 12. In addition, provision of the EL layers 26 directly under the back of the key buttons 4 has an advantage of improving the illuminance efficiency of the key buttons 4 per consumed current of the EL light 11.

EMBODIMENT 15

Figures 21A, 21B, 21C:
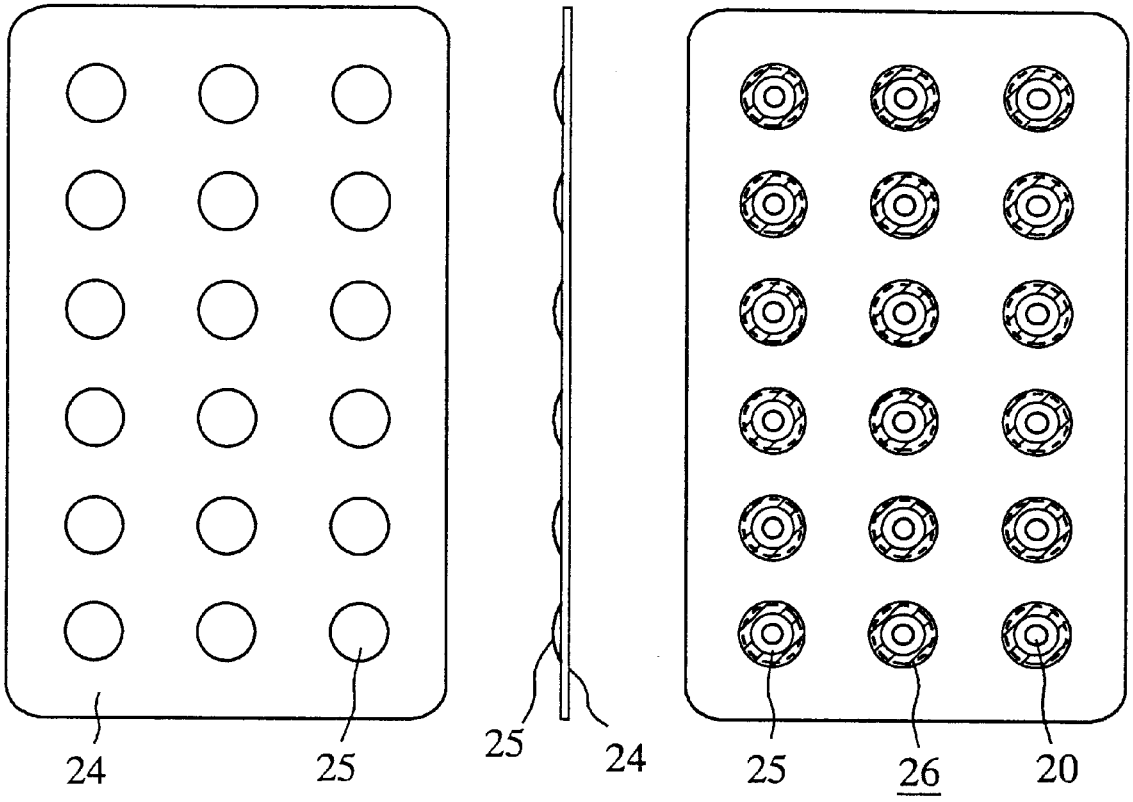
FIGS. 21A–21C are plan, side and bottom views of the film click board of an embodiment 15 of the lighted switch illuminator in accordance with the present invention, respectively.
Figure 22:
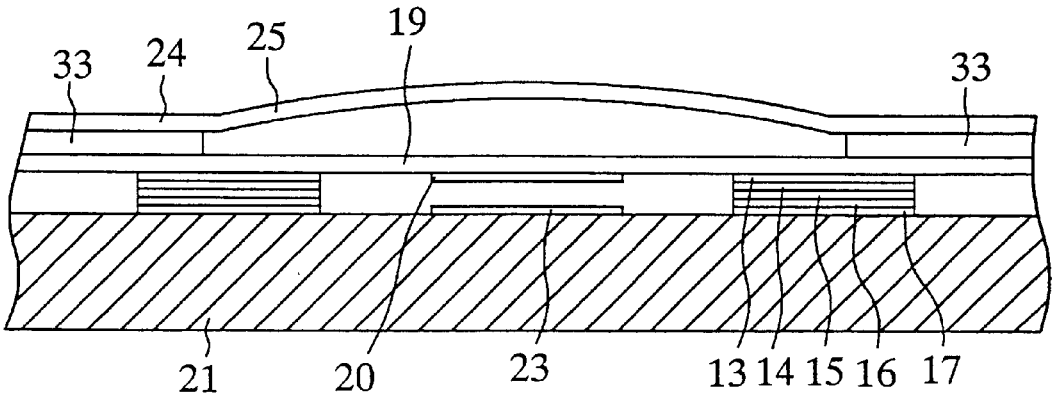
FIG. 22 is a cross-sectional view of the embodiment 15 of the lighted switch illuminator in accordance with the present invention.
Figure 23:
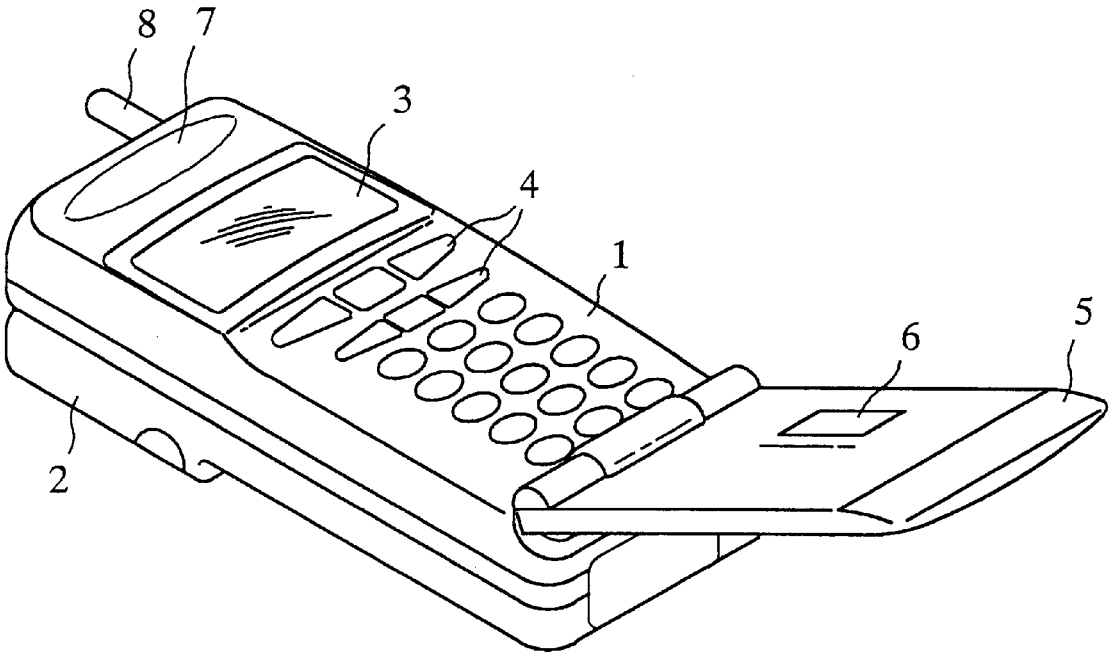
FIG.23(PRIOR ART)
FIG. 23 is a perspective view showing a conventional portable telephone.

FIGS. 21A–21C are plan, side and bottom views of the film click board of an embodiment 15 of the lighted switch illuminator in accordance with the present invention, and FIG. 22 is an enlarged cross-sectional view showing a part of the lighted switch.

In these figures, EL layers 26 are formed by sequentially stacking, on the back of the switch electrode sheet 19, the transparent electrode layer 13, the light emitting layer 14, the dielectric layer 15, the rear electrode layer 16 and the insulation layer 17, in such a manner that the EL layers 26 extend across the portions corresponding to part of the hollow convex portions 25 of the film click board 24 and their peripheries.

The present embodiment 15 differs from the embodiment 8 in that the EL layers 26 extend even to the portions corresponding to the inner part of the hollow convex portions 25. This, however, offers an advantage of further improving the illuminance efficiency of the key buttons 4 per consumed current of the EL light 11 as compared with the embodiment 8.

EMBODIMENT 16

Although the above describes the embodiments of the lighted switch illuminator in accordance with the present invention, the embodiments of the fabrication method of the lighted switch illuminator will now be described.

First, the fabrication method of the lighted switch illuminator will be described in which the EL light 11 is stacked throughout the back of the film click board 24 excluding the regions corresponding to the hollow convex portions 25.

In the first step, the film click board 24 functioning as the base film of the EL light 11 undergoes pressing under heating to form the dome-like hollow convex portions 25. The pressing is carried out by putting the film click board 24 between a convex mold in which dome-like convex portions are arrayed, and its matching concave mold in which dome-like concave portions are arrayed.

In the second step, the EL layer 26 is formed by successively stacking the transparent electrode layer 13, light emitting layer 14, dielectric layer 15, rear electrode layer 16 and insulation layer 17 in this order on the back of the film click board 24 excluding the areas corresponding to the hollow convex portions 25 formed in the film click board 24. The stack of the layers can be sequentially formed using printing technique.

In the third step, the upper contacts 20 are formed on regions on the back of the film click board 24 corresponding to the areas of the hollow convex portions 25. They can be made of carbon ink using the printing technique.

Although the third step follows the second step in the foregoing description, it is not essential. The third step can be carried out immediately after the first step, followed by the second step. In addition, the hollow convex portions 25 of the first step can be formed after forming the upper contacts 20 of the third step.

EMBODIMENT 17

Although the foregoing embodiment 16 forms the hollow convex portions 25 in the film click board 24, and then stacks the EL layer 26, they can be formed in the reverse order.

In the first step, the EL layer 26 is formed by successively stacking the transparent electrode layer 13, light emitting layer 14, dielectric layer 15, rear electrode layer 16 and insulation layer 17 in this order on the back of the film click board 24 excluding the areas on the film click board 24 in which the hollow convex portions 25 are to be formed.

In the second step, the film click board 24 on which the layers have been stacked undergoes pressing under heating to form the dome-like hollow convex portions 25.

In the third step, the upper contacts 20 are formed on the back of the film click board 24 at regions corresponding to the hollow convex portions 25.

Although the third step follows the second step in the foregoing description, it is not essential. The third step can be carried out immediately after the first step, followed by the second step. In addition, the stacking of the layers of the first step can be carried out after forming the upper contacts 20 of the third step.

EMBODIMENT 18

Although the step of stacking the EL light 11 and the step of forming the upper contacts 20 are carried out separately in the foregoing embodiments 16 and 17, the step of forming the upper contacts 20 can be carried out simultaneously with the step of stacking the rear electrode layer 16 in the step of stacking the EL light 11.

In the first step, the film click board 24 undergoes pressing under heating to form the dome-like hollow convex portions 25.

In the second step, the transparent electrode layer 13, light emitting layer 14 and dielectric layer 15 are successively stacked on the back of the film click board 24 excluding the areas corresponding to the hollow convex portions 25 formed in the film click board 24.

In the third step, the rear electrode layer 16 made of carbon ink is formed on the dielectric layer 15 excluding the areas corresponding to the hollow convex portions 25, and at the same time, the upper contacts 20 made of the carbon ink are formed at the areas corresponding to the hollow convex portions 25 on the back of the film click board 24. In this case, although the position in the vertical direction of the rear electrode layer 16 to be stacked slightly differs from that of the upper contacts 20 to be formed, their difference is very small and hence they can be printed simultaneously using a well-known printing technique.

In the fourth step, the insulation layer 17 is stacked on the rear electrode layer 16 in the region excluding the areas corresponding to the hollow convex portions 25.

EMBODIMENT 19

Next, a fabrication method of the lighted switch illuminator will be described in which the EL light 11 is stacked even on the interior of the concave portions at the back of the hollow convex portions.

In the first step, the film click board 24 undergoes pressing under heating to form the dome-like hollow convex portions 25 on its surface.

In the second step, the EL layer 26 is formed by successively stacking the transparent electrode layer 13, light emitting layer 14, dielectric layer 15, rear electrode layer 16 and insulation layer 17 in this order on the back of the film click board 24 including the areas corresponding to the hollow convex portions 25.

In the third step, the upper contacts 20 are formed on the insulation layer 17 corresponding to the areas of the hollow convex portions 25.

EMBODIMENT 20

Although the foregoing embodiment 19 forms the hollow convex portions 25 on the film click board 24, and then stacks the EL layer 26, they can be formed in the reverse order.

In the first step, the EL layer 26 is formed by successively stacking the transparent electrode layer 13, light emitting layer 14, dielectric layer 15, rear electrode layer 16 and insulation layer 17 in this order on the back of the film click board 24.

In the second step, the film click board 24 undergoes pressing to form the hollow convex portions 25 protruding from the film click board 24.

In the third step, the upper contacts 20 are formed on the insulation layer 17 corresponding to the areas of the hollow convex portions 25.

Although the third step of forming the upper contacts 20 follows the second step of forming the hollow convex portions 25 in the foregoing description, it can be reversed so that the upper contacts 20 are formed first, and then the hollow convex portions 25 are formed.

EMBODIMENT 21

Next, a fabrication method of the lighted switch illuminator will be described in which the EL layers 11 are stacked only at the back of the hollow convex portions.

In the first step, the film click board 24, the base film of the EL layers 11, undergoes pressing under heating to form the dome-like hollow convex portions 25 on its surface.

In the second step, the EL layers 26 are formed by successively stacking the transparent electrode layer 13, light emitting layer 14, dielectric layer 15, rear electrode layer 16 and insulation layer 17 on the concave portions at the back of the hollow convex portions 25 formed in the film click board 24.

In the third step, the upper contacts 20 are formed on the insulation layer 17 of the EL layers 26. The upper contacts 20 can be formed by printing using the carbon ink as a material.

What is claimed is:

1. A lighted switch illuminator provided behind at least one key button for illuminating the key button, said lighted switch illuminator comprising:

a base film, functioning as a base film for an electroluminescent (EL) layer, having a first surface which is operatively depressed by said key button;

at least one first contact formed on a second surface of said base film at a region corresponding to said key button;

at least one second contact formed on a printed circuit board such that said second contact faces said first contact; and said EL layer formed on the second surface of said base film, excluding regions of said base film at which said first contacts are formed.

2. The lighted switch illuminator as claimed in claim 1, wherein said base film is a film click board having a first surface facing said key buttons.

3. The lighted switch illuminator as claimed in claim 2, wherein said film click board has on said first surface at least one hollow convex portion protruding toward the said key button.

4. The lighted switch illuminator as claimed in claim 3, wherein said EL layer consists of ring-like layers formed at regions surrounding said hollow convex portions of said film click board.

5. The lighted switch illuminator as claimed in claim 3, wherein said EL layer has air grooves opening an internal space of said hollow convex portion to an external space.

6. The lighted switch illuminator as claimed in claim 3, wherein said EL layer has air grooves for transmitting air between said hollow convex portion and a second hollow convex portion on said film click board.

7. The lighted switch illuminator as claimed in claim 3, wherein said EL layer extends into an internal space of said hollow convex portion.

8. The lighted switch illuminator as claimed in claim 2, wherein said film click board is a flat film.

9. The lighted switch illuminator as claimed in claim 1, wherein said base film is a switch electrode sheet on which printed wiring of a switch circuit is formed.

10. The lighted switch illuminator as claimed in claim 9, further comprising a film click board having at least one hollow convex portion protruding toward said key button, wherein said EL layer consists of ring-like layers each formed on said second surface of said switch electrode sheet at a region corresponding to a periphery and part of an interior of said hollow convex portion.

11. The lighted switch illuminator as claimed in claim 1, wherein said EL layer comprises a transparent electrode layer, a light emitting layer, a dielectric layer, a rear electrode layer and an insulation layer stacked in order.

12. A lighted switch illuminator provided behind at least one key button for illuminating the key button, said lighted switch illuminator comprising:

a film click board having on a first surface thereof at least one hollow convex portion protruding toward said key button;

at least one first contact operatively depressed by said key button, said first contact corresponding to said key button;

at least one second contact formed on a printed circuit board such that said second contact faces said first contact; and an (EL) layer formed at least at a back of said hollow convex portion on said film click board.

13. The lighted switch illuminator as claimed in claim 12, wherein said first contact is formed on said EL layer.

14. The lighted switch illuminator as claimed in claim 13, wherein said EL layer is formed throughout the second surface of said film click board.

15. The lighted switch illuminator as claimed in claim 13, wherein said EL layer consists of a plurality of unit layers formed on said hollow convex portion.

16. The lighted switch illuminator as claimed in claim 12, further comprising a switch electrode sheet with a first surface facing said film click board and said EL layer, wherein said first contact is formed on a second surface of said switch electrode sheet at a region corresponding to said key button.

17. The lighted switch illuminator as claimed in claim 16, wherein said EL layer consists of a plurality of unit layers formed on said hollow convex portion.

18. A fabrication method of a lighted switch illuminator comprising the steps of:

forming at least one hollow convex portion protruding from a first surface of a film click board;

forming an electroluminescent (EL) layer on a second surface of said film click board excluding a region corresponding to said hollow convex portion; and forming at least switch contact at a back of said hollow convex portion.

19. A fabrication method of a lighted switch illuminator comprising the steps of:

forming at least one hollow convex portion protruding from a first surface of a film click board;

forming part of an electroluminescent (EL) layer by successively stacking a transparent electrode layer, a light emitting layer and a dielectric layer on a second surface of said film click board excluding a region corresponding to said hollow convex portion;

stacking on said dielectric layer a rear electrode layer composed of carbon ink, and simultaneously forming at a back of said hollow convex portion a switch contact composed of the carbon ink; and stacking on said rear electrode layer an insulation layer, thereby completing said EL layer.

20. A fabrication method of a lighted switch illuminator comprising the steps of:

forming at least one hollow convex portion protruding from a first surface of a film click board;

forming an electroluminescent (EL) layer on a second surface of said film click board at least at a region corresponding to said hollow convex portion; and forming at least one switch contact on said EL layer at a region corresponding to said hollow convex portion.

* * * * *

UNITED STATES PATENT AND TRADEMARK OFFICE

CERTIFICATE OF CORRECTION

PATENT NO. : 5,901,834
DATED : May 11, 1999
INVENTOR(S) : Toshiya Inubushi and Tsutomu Inoue It is certified that error appears in the above-identified patent and that said Letters Patent is hereby corrected as shown below:

Title page,
Item [56], References Cited, Foreign Application Priority Data,
change "May 12, 1996" to -- December 5, 1996 --;

Column 1,
Line 12, delete "if";

Column 4,
Line 58, "FIG. 3 s" should be -- FIG. 3 is --;

Column 13,
Line 9, delete "the";
Line 13, "portions" should be -- portion --;
Line 53, before "(EL)" insert -- electroluminescent --.

Signed and Sealed this

Twenty-ninth Day of October, 2002

*Attest:*

*Attesting Officer*

JAMES E. ROGAN
*Director of the United States Patent and Trademark Office*